US008469044B1

(12) United States Patent
Patel

(10) Patent No.: US 8,469,044 B1
(45) Date of Patent: Jun. 25, 2013

(54) UMBRELLA WITH MULTIPLE CANOPY STRUCTURE

(76) Inventor: Vinod Patel, Jacksonville, FL (US)

( * ) Notice: Subject to any disclaimer, the term of this patent is extended or adjusted under 35 U.S.C. 154(b) by 0 days.

(21) Appl. No.: 13/085,558

(22) Filed: Apr. 13, 2011

(51) Int. Cl.
*A45B 25/18* (2006.01)
*A45B 25/22* (2006.01)

(52) U.S. Cl.
USPC ..... 135/33.7

(58) Field of Classification Search
USPC ..... 135/33.2, 33.7, 20.1
See application file for complete search history.

(56) References Cited

U.S. PATENT DOCUMENTS

| | | | | |
|---|---|---|---|---|
| 212,457 | A | 2/1879 | Girbardt | |
| 3,456,661 | A | 7/1969 | Farley | |
| 4,865,063 | A | 9/1989 | Williams | |
| 5,078,166 | A | 1/1992 | Lee | |
| 5,865,201 | A | 2/1999 | Lin | |
| 6,024,109 | A * | 2/2000 | Lin et al. | 135/33.7 |
| 6,089,244 | A * | 7/2000 | Ko | 135/33.7 |
| 6,095,171 | A * | 8/2000 | Lin et al. | 135/33.7 |
| 6,170,499 | B1 | 1/2001 | Lin | |
| 6,173,724 | B1 | 1/2001 | You | |
| 6,250,319 | B1 | 6/2001 | You | |
| 6,328,046 | B2 * | 12/2001 | Doreste | 135/15.1 |
| 6,502,592 | B2 * | 1/2003 | Chen | 135/33.7 |
| 6,601,597 | B2 * | 8/2003 | Sung | 135/33.7 |
| 6,941,959 | B2 * | 9/2005 | Kung-Tai | 135/33.7 |
| 7,415,986 | B2 * | 8/2008 | Wu | 135/33.7 |
| 7,461,667 | B2 * | 12/2008 | Ko | 135/31 |
| 2003/0029486 | A1 * | 2/2003 | Ko | 135/33.7 |
| 2003/0041888 | A1 * | 3/2003 | Sung | 135/16 |
| 2003/0098050 | A1 * | 5/2003 | Lee | 135/33.7 |
| 2003/0230327 | A1 | 12/2003 | You | |
| 2004/0211452 | A1 * | 10/2004 | Wu | 135/33.7 |
| 2006/0272687 | A1 | 12/2006 | Tanner et al. | |
| 2008/0061524 | A1 | 3/2008 | Goldszer | |

* cited by examiner

*Primary Examiner* — David Dunn
*Assistant Examiner* — Danielle Jackson
(74) *Attorney, Agent, or Firm* — Neustel Law Offices

(57) ABSTRACT

The umbrella includes a shaft, a lower canopy having a central opening, and an upper canopy thereabove over the opening. A first supporting assembly includes ribs, stretchers, and a runner and is connected to the shaft and first and second canopies to operably move the canopies between closed and open positions, wherein an inner portion of the upper canopy moves with the ribs. A second supporting assembly is connected to the ribs of the first assembly within the opening and connected to an outer portion of the upper canopy for operably moving the outer portion of the upper canopy between concave and convex positions while the lower canopy and inner portion of the upper canopy are retained in the concave position, such that the outer portion of the upper canopy covers the opening when concave to restrict air passage and exposes the opening when convex to permit air passage.

16 Claims, 5 Drawing Sheets

UMBRELLA WITH MULTIPLE CANOPY STRUCTURE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to an umbrella and more specifically it relates to a umbrella with multiple canopy structure for permitting wind and air passage between the multiple canopies to prevent damage to the umbrella.

2. Description of the Related Art

Any discussion of the related art throughout the specification should in no way be considered as an admission that such related art is widely known or forms part of common general knowledge in the field.

Prior art umbrellas generally provide a single canopy suited for blocking rain or sun to a person or object underneath. However, during periods of excessive wind, the wind can easily cause the canopy to be damaged due to the relatively lightweight and weak structure of the canopy and supporting members and also since wind can become trapped by the canopy which increases a force displaced upon the canopy.

Because of the inherent problems with the related art, there is a need for a new and improved umbrella with multiple canopy structure for permitting wind and air passage between the multiple canopies to prevent damage to the umbrella.

BRIEF SUMMARY OF THE INVENTION

A system for permitting wind and air passage between the multiple canopies to prevent damage to the umbrella. The invention generally relates to an umbrella which includes a shaft, a lower canopy having a central opening, and an upper canopy thereabove to cover and expose the opening. A first supporting assembly including ribs, stretchers, and a runner is connected to the shaft and lower canopy to operably move the first and second canopies between closed and open positions, wherein an inner portion of the upper canopy moves with the ribs. A second supporting assembly is connected to the ribs of the first assembly within the opening and connected to an outer portion of the upper canopy for operably moving the outer portion of the upper canopy between concave and convex positions while the lower canopy and inner portion of the upper canopy are retained in the concave position, such that the upper canopy covers the opening when concave to restrict air passage and exposes the opening when convex to permit air passage.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
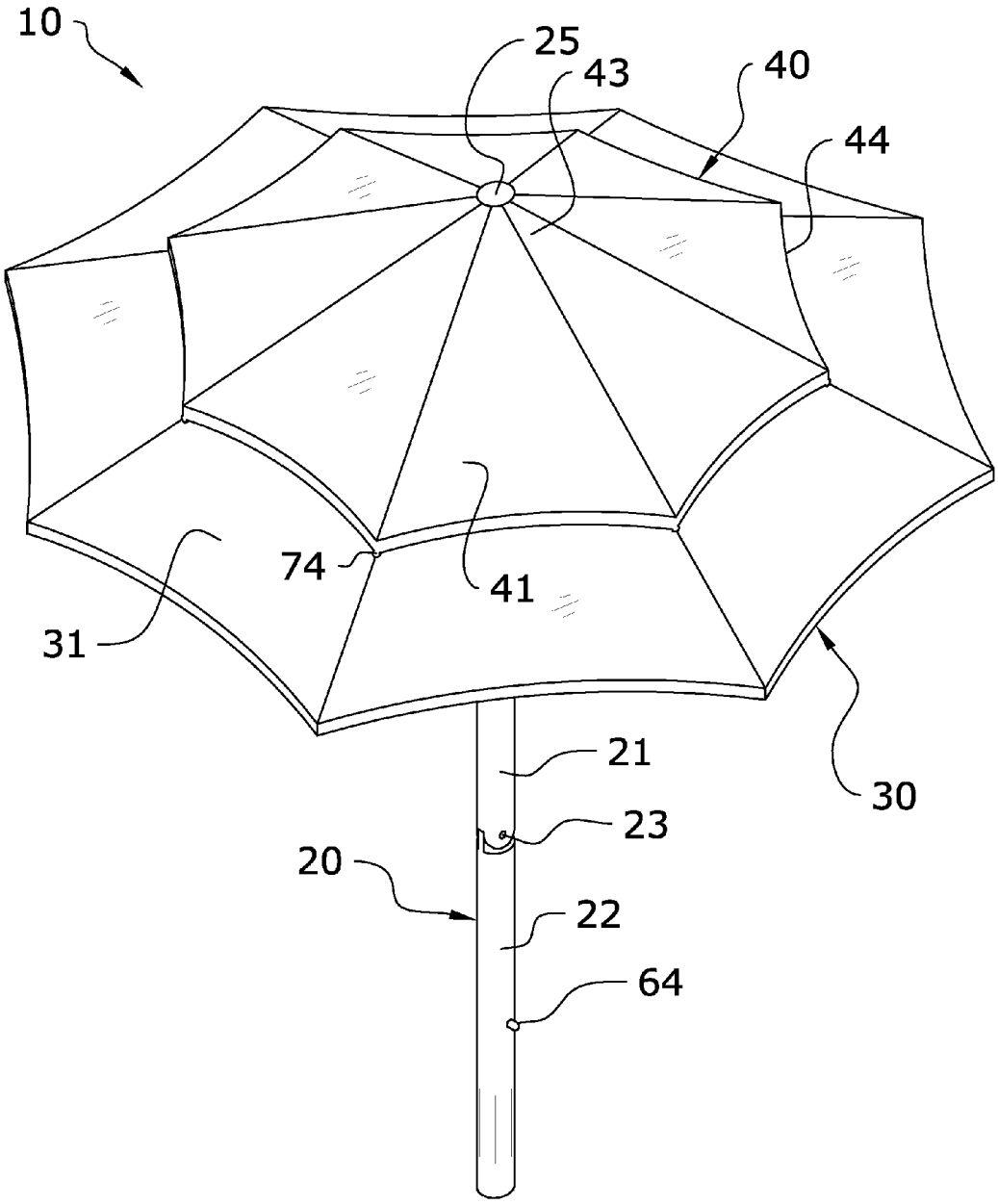
FIG. 1 is an upper perspective view of the present invention.
Figure 2:
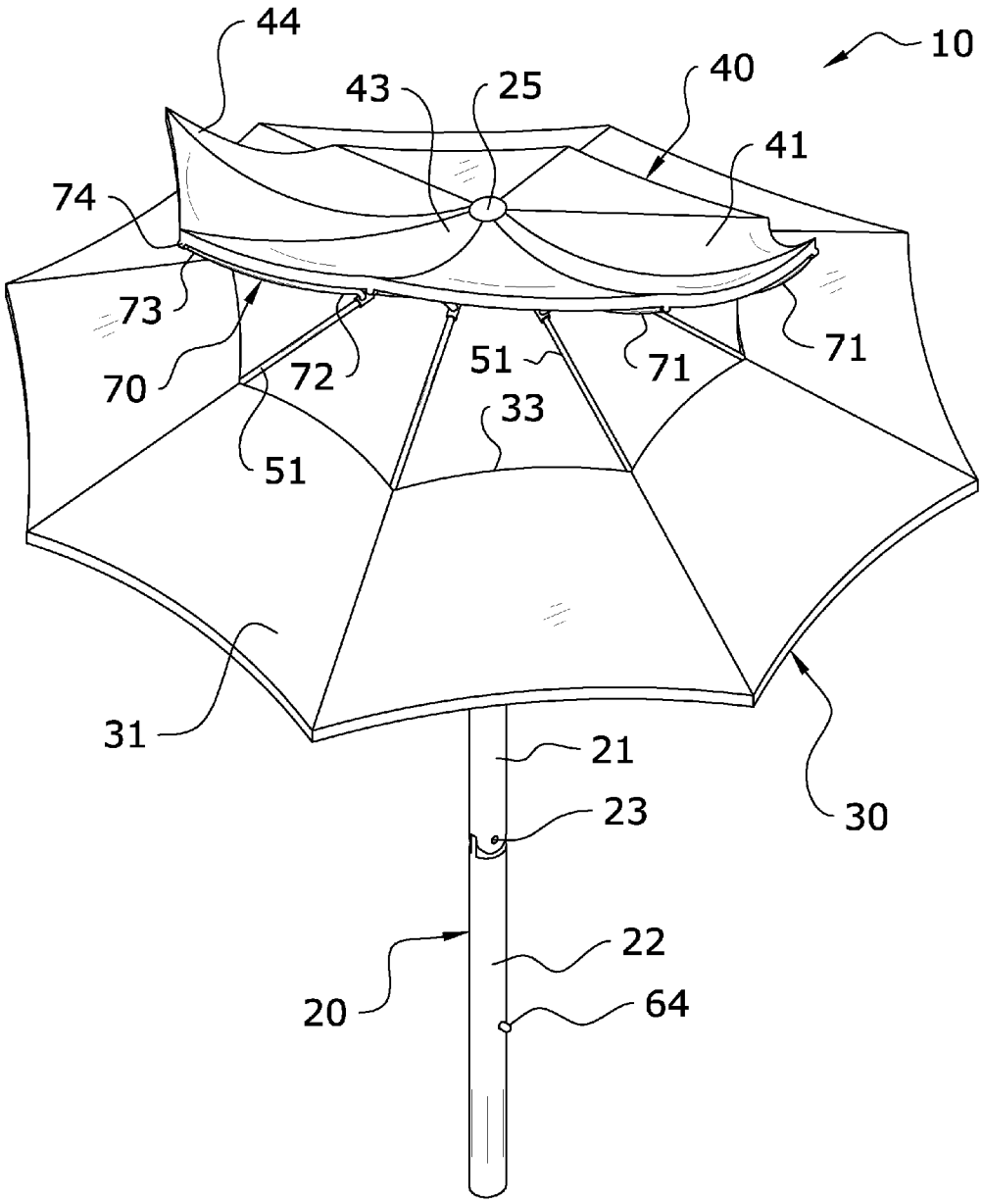
FIG. 2 is an upper perspective view of the present invention with the upper canopy partially inverted (convex).
Figure 3:
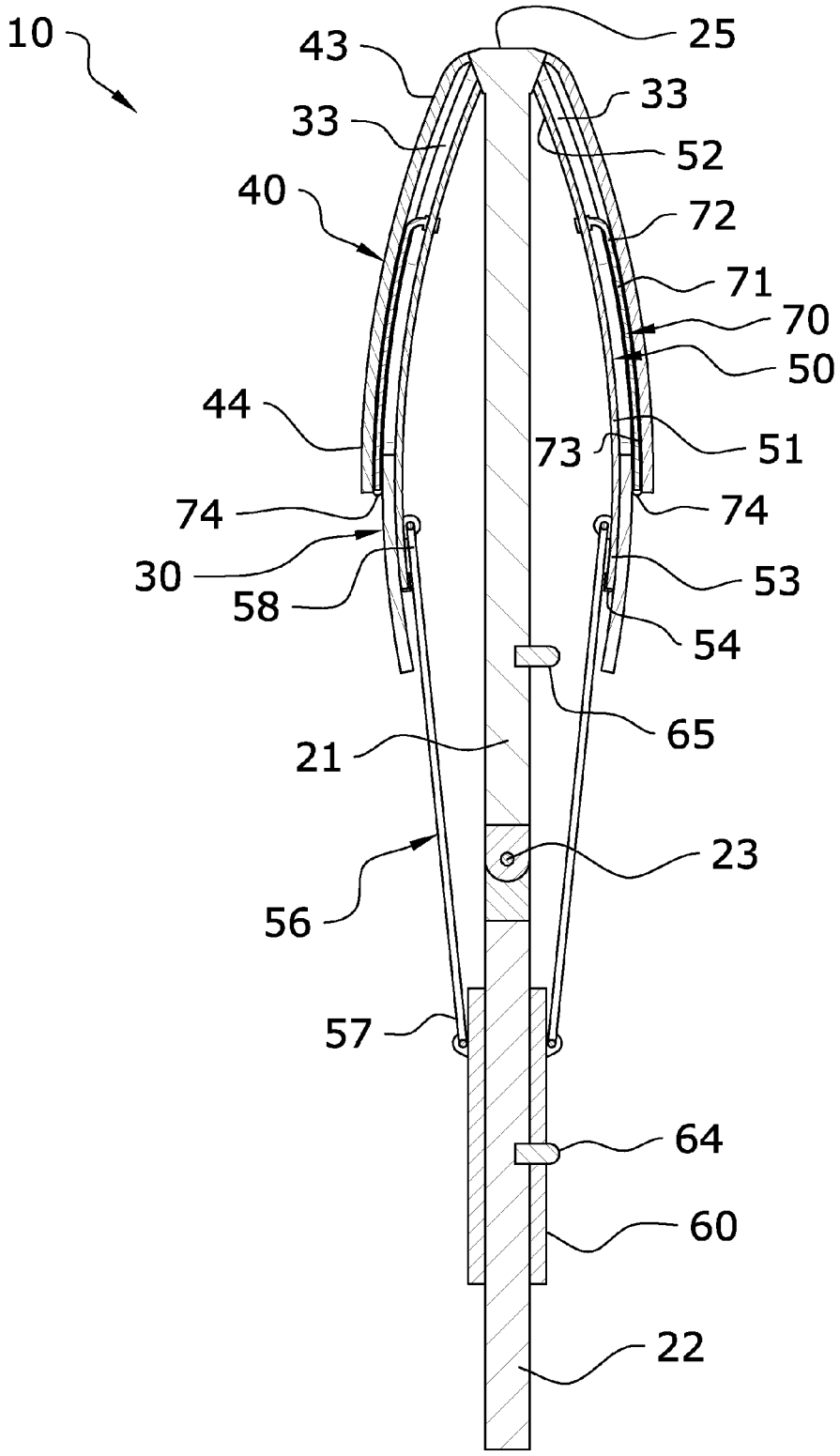
FIG. 3 is a sectional view of the present invention in the closed position.
Figure 4:
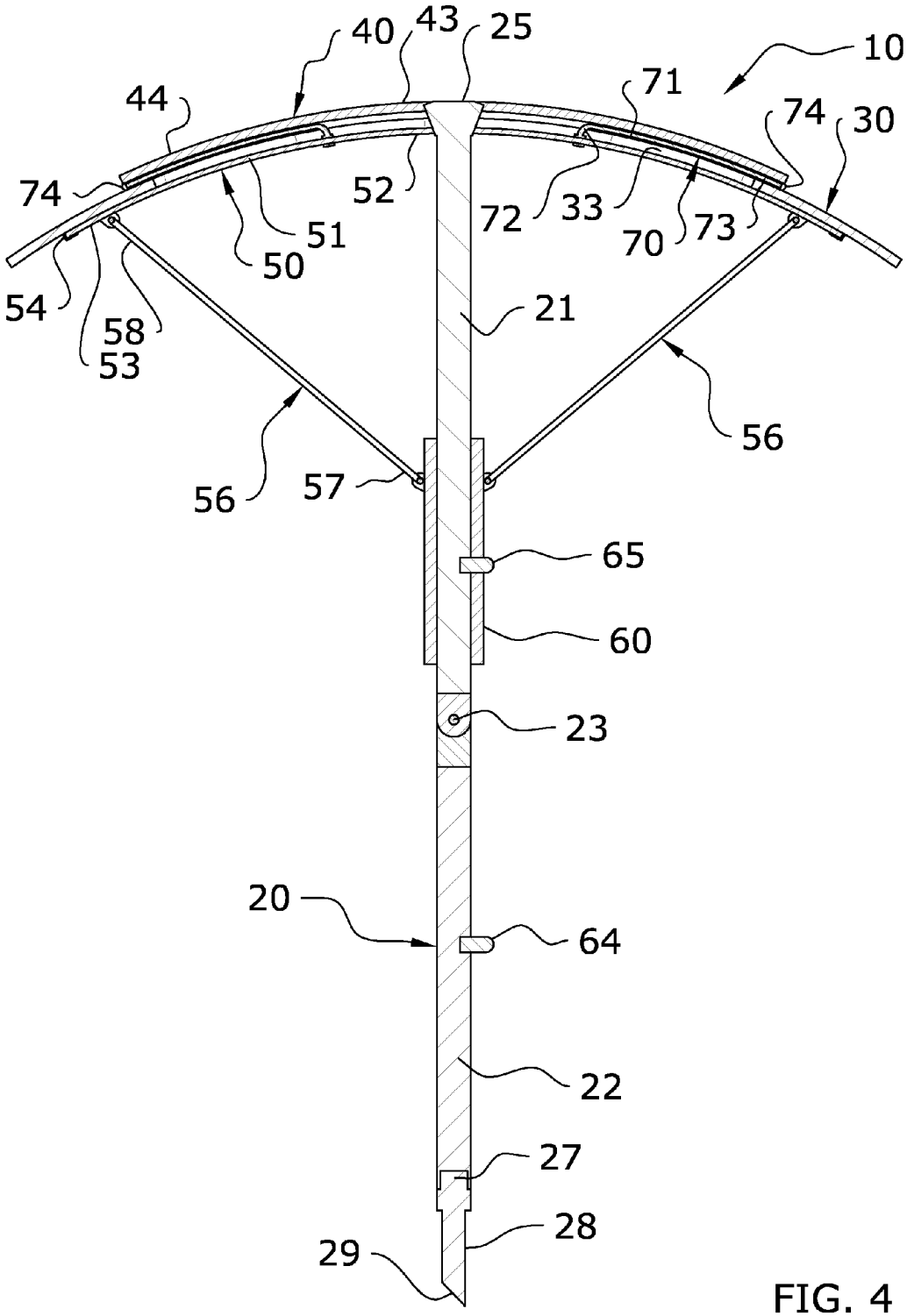
FIG. 4 is a sectional view of the present invention in the open position with both the first and second canopies concave.
Figure 5:
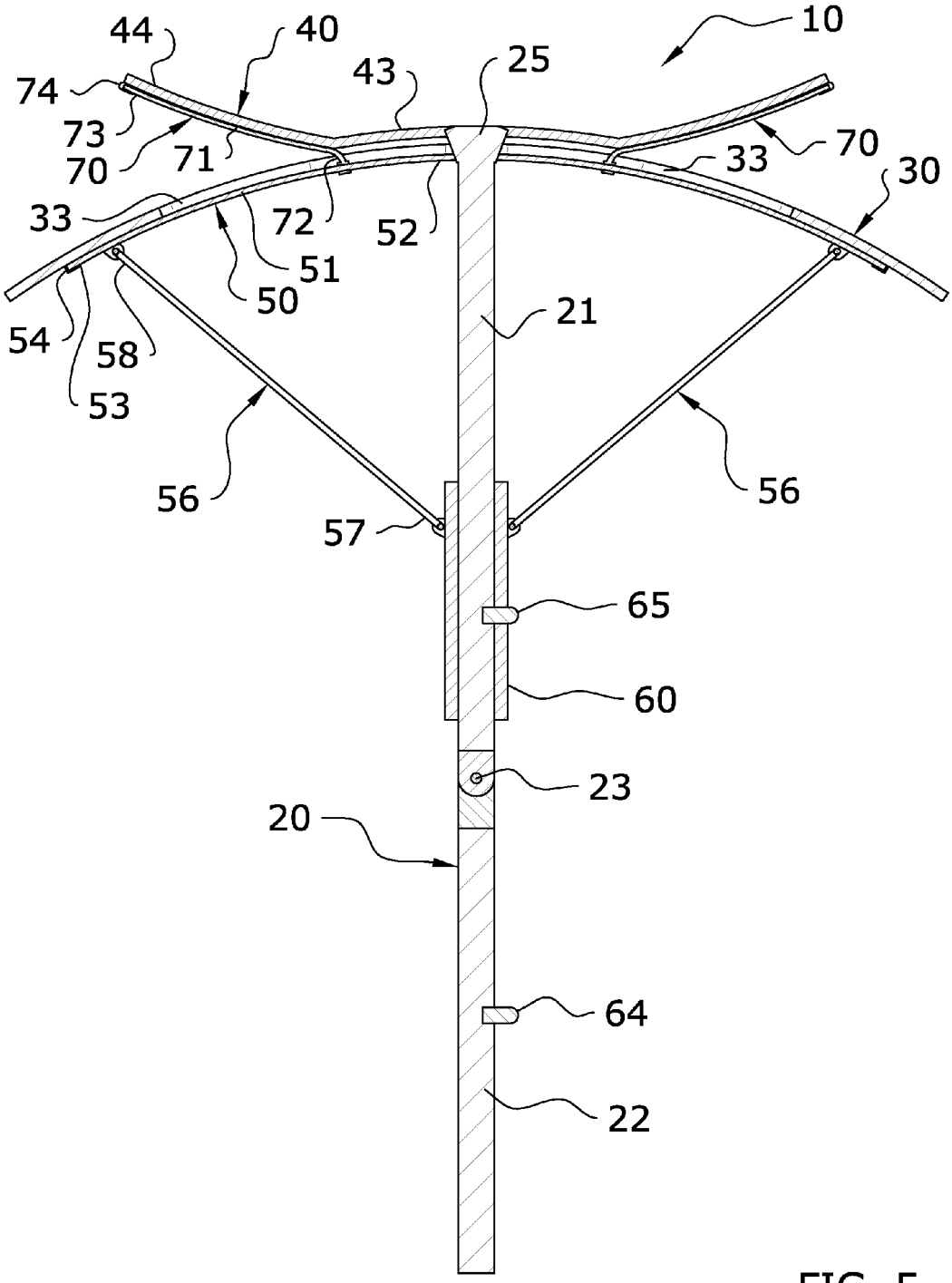
FIG. 5 is a sectional view of the present invention in the open position with the lower canopy concave and the upper canopy convex.

Turning now descriptively to the drawings, in which similar reference characters denote similar elements throughout the several views, FIGS. 1 through 5 illustrate a umbrella with multiple canopy structure 10, which comprises a shaft 20, a lower canopy 30 having a central opening 33, and an upper canopy 40 thereabove to cover and expose the opening 33. A first supporting assembly 50 including ribs 51, stretchers 56, and a runner 60 is connected to the shaft 20 and lower canopy 30 to operably move the first and second canopies 30, 40 between closed and open positions, wherein an inner portion 43 of the upper canopy 40 moves with the ribs 51. A second supporting assembly 70 having ribs 71 is connected to the ribs 51 of the first assembly within the opening 33 and connected to an outer portion 44 of the upper canopy 40 for operably moving the outer portion 44 of the upper canopy 40 between concave and convex positions while the lower canopy 30 and inner portion 43 of the upper canopy 40 are retained in the concave position, such that the upper canopy 40 covers the opening 33 when concave to restrict air passage and exposes the opening 33 when convex to permit air passage. A case (not shown) may also be included with the umbrella 10 for transporting and storing the umbrella 10.

B. Shaft

The shaft 20 is generally comprised of an elongated structure, being hollow or solid, and employing a circular or other cross-sectional shape. The shaft 20 may be adjustable in length, such as by being telescopic or otherwise lengthwise adjustable. The shaft 20 may also include a pivotal connector 23 such as to adjust the angular position of the shaft 20. For example the upper portion 21 of the shaft 20 may be angled with respect to the lower portion 22. The pivotal connector 23 permits for the upper portion 21 and the lower portion 22 to be removably secured in various angular relationships.

The shaft 20 may also include a fixed upper mount 25 secured to the upper end of the upper portion 21 and a lower element 29 secured to the lower end of the lower portion 22. The lower element 29 may be a handle; however in the preferred embodiment, the lower element 29 is generally a ground-engaging spike, wherein the present invention is generally utilized as a beach or garden umbrella 10. Alternately, the lower end of the lower portion 22 of the shaft 20 may simply terminate without a distinguished lower element 29. Also optionally available for the shaft 20 is a lower pole-elongated extension 28 that removably attaches to the shaft 20. The extension 28 may include a connector 27 having an operable lever for applying pressure for tightening and loosening the extension 28 upon the shaft 20. The extension 28 may include a ground engaging lower element 29 or other type of lower element.

C. Lower Canopy

The lower canopy 30 is secured near the upper mount 25 and upper end of the shaft 20 and is pivotal therefrom via the first supporting assembly 50 as will be discussed. The lower canopy 30 generally comprises a plurality of liquid-impermeable panels 31 attached together; however a unitary structure may also be appreciated. As also appreciated, the lower canopy 30 may be of various colors and employ various designs.

The lower canopy 30 has an opening 33 at the center of the lower canopy 30. The opening 33 is preferably concentric with the shaft 20. The opening 33 permits for wind passage or air circulation when the upper canopy 40 is in an inverted or convex position, yet the opening 33 is small enough to be covered by the upper canopy 40 when the upper canopy 40 is in the concave position such as to substantially parallel the shape of the lower canopy 30.

D. Upper Canopy

The upper canopy 40 is secured near the upper mount 25 and upper end of the shaft 20 and above the lower canopy 30. The upper canopy 40 is also pivotal therefrom via the first supporting assembly 50 as will be discussed. The upper canopy 40 is further adapted to move independently from a concave position to a convex position. The upper canopy 40 generally comprises a plurality of liquid-impermeable panels 41 attached together; however a unitary structure may also be appreciated. As also appreciated, the upper canopy 40 may be of various colors and employ various designs different or the same as the lower canopy 30.

The inner portion 43 of the canopy is generally secured or retained along the ribs of the first supporting assembly 50 to move between the upper canopy 40 between the closed and open positions with the lower canopy 30. The inner portion 43 is preferably retained along the ribs 51 by the inner part of the inner portion 43 being retained to the shaft 20 or upper mount 25 and the outer part of the inner portion 43 being retained to the ribs 51 via the inner end 72 of the ribs 71 of the second supporting assembly 70. The outer portion 44 is not directly secured to the first supporting assembly 50 and thus is able to independently move from the concave position (parallel with the lower canopy 30 in the open position) to the convex position (inverted outwardly and angling away from the lower canopy 30). Thus, the inner portion 43 always retains the general shape of the ribs of the first supporting assembly 50.

In the concave position, the upper canopy 40 extends past the opening 33 and overlaps a portion of the lower canopy 30 such as to substantially restrict air passage through the opening 33. Thus, the upper canopy 40 has a diametric size generally larger than the opening 33 of the lower canopy 30. In the convex position of the upper canopy 40, the upper canopy 40 inverts to angle upwardly thus forming a gap between the outer portion 44 of the upper canopy 40 and the lower canopy 30 to expose the opening 33 and permit lateral air passage therethrough. It is appreciated that in either position of the upper canopy 40, the upper canopy 40 extends sufficiently laterally outward from the opening 33 such as to prevent a downward rain from passing through the opening 33, wherein the opening 33 is always covered from directly above via the upper canopy 40.

E. First Supporting Assembly

The first supporting assembly 50 generally includes a plurality of ribs 51 having an inner end 52 and an outer end 53 that is capped via caps 54, a plurality of stretchers 56 having an outer end 58 pivotally connected to an intermediary portion along each of the ribs 51 and an inner end 57 pivotally connected to a movable runner 60, wherein the runner 60 slides along the length of the shaft 20 to move the lower canopy 30 and upper canopy 40 from a closed position to an open position.

The runner 60 is generally secured in the closed position via a first biased-retainer 64, such as a springed-element laterally movably extending from the lower portion 22 of the shaft 20, and the runner 60 is generally secured in the open position via a second biased-retainer 65, such as a springed-element laterally movably extending from the upper portion 21 of the shaft 20. A button or other mechanism may be employed upon the runner 60 or extending from the shaft 20 or retainers to release the runner 60 from the first biased-retainer 64 or the second biased-retainer 65 as appreciated. Various conventional structures may alternately be used to permit the lower canopy 30 to move between the closed and open positions.

The ribs 51 are generally comprised of flexible, bendable and semi-rigid metal or plastic members with the inner end 52 secured to the upper end of the shaft 20 or the upper mount 25, wherein the outer end 53 of the ribs 51 pivots between the open position, such as to extend laterally outward from the shaft 20 and a closed position, such as to extend substantially parallel along the shaft 20. The lower canopy 30 is attached along the ribs 51 on an upper surface of the ribs 51 and each of the ribs 51 generally has a cap 54 mounted on an outer end 53 for safety and to retain the lower canopy 30 in place. It is appreciated that the ribs 51 extend outwardly from the lower canopy 30 to receive the cap 54. The cap 54 may also be integrated into the lower canopy 30, such as to be fixed with the lower canopy 30, thus permitting the ribs 51 and lower canopy 30 to snap into a concave position such as when moved to the open position. The lower canopy 30 may also include a hanging portion that extends past the caps 54 and freely-hangs downward to further block wind and sunlight and also for aesthetic purposes.

It is also appreciated that the inner portion 43 of the upper canopy 40 is also generally secured along the upper surface of the ribs 51. The inner portion 43 of the upper canopy 40 only extends to a point approximately half-way across the opening 33, wherein the outer portion 44 of the upper canopy 40 extends outward from the inner portion 43 at the connection location of the first ribs 51 and the second ribs 71 and the outer portion 44 is movable with respect to the ribs 51 of the first supporting assembly 50 and thus not directly attached thereto.

F. Second Supporting Assembly

The second supporting assembly 70 generally includes a plurality of ribs 71, each having an inner end 72 attached to a respective rib 51 of the first supporting assembly 50 approximately half-way across the opening 33 or at least within the opening 33, and each having an outer end 73 that is capped via caps 74. The ribs 71 are generally comprised of flexible, bendable and semi-rigid metal or plastic members, wherein the ribs 71 are adapted to bend and be retained, via snapping-to, in a concave or convex position. The upper canopy 40 is attached along the ribs 71 on an upper surface of the ribs 71 and each of the ribs 71 generally has a cap 74 mounted on an outer end 73 for safety and to retain the upper canopy 40 in place along the ribs 71.

It is appreciated that the ribs 71 extend outwardly from the upper canopy 40 to receive the cap 74. The cap 74 may also be integrated into the upper canopy 40, such as to be fixed with the upper canopy 40. The ribs 71 thus preferably extend outwardly from the upper canopy 40 which permits the ribs 71 and upper canopy 40 to snap into a respective convex or concave position and ensure that the outer portion 44 also moves to the respective convex or concave position to parallel the ribs 71.

G. Operation of Preferred Embodiment

In use, in the closed position, the ribs 51 of the first supporting assembly 50 substantially parallel the shaft 20 and extend from the upper end of the shaft 20 towards the lower end of the shaft 20. The ribs 71 of the second supporting assembly 70 also substantially parallel the shaft 20 and likewise extend towards the lower end of the shaft 20. Thus, the lower canopy 30 and the upper canopy 40 are also retained in a manner to substantially parallel the shaft 20 and extend towards the lower end of the shaft 20.

To open the umbrella 10 or move the lower canopy 30 and the upper canopy 40 to the open position, runner 60 is moved along the shaft 20 towards the upper end. As the runner 60 moves towards the upper end of the shaft 20, the outer end of the stretchers 56 are caused to pivot outwardly which causes the ribs 51 of the first supporting assembly 50 to pivot outwardly until the runner 60 becomes locked in place by the second biased-retainer 65. At this point, both the lower canopy 30 and the upper canopy 40 are in the concave position and the upper canopy 40 overlaps the lower canopy 30 and completely covers the opening 33 of the lower canopy 30.

If it is desired to move the upper canopy 40 from the concave position to the inverted, convex position, upward pressure is applied upon the ribs 71 of the second supporting assembly 70. The upward force causes the ribs 71 to move from a downwardly-angled concave position to an upwardly-angled convex position and be snapped in place in the convex position, which also causes the outer portion 44 of the upper canopy 40 to be snapped into and retained in the convex position. With the lower canopy 30 retained in the concave position and the outer portion 44 of the upper canopy 40 retained in the convex position, a gap is formed therebetween which permits air passage through the opening 33, thus venting the umbrella 10 and allowing air current or wind to freely pass through.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An umbrella with multiple canopy structure, comprising:

a shaft;

a lower canopy having an opening;

an upper canopy having an inner portion and an outer portion, wherein said upper canopy is supported above said lower canopy and over said opening;

a first supporting assembly connected to said shaft and said first and second canopies to operably move said first and second canopies between a closed position and an open position, wherein said inner portion of said upper canopy moves with said first supporting assembly; and a second supporting assembly connected to said first supporting assembly within said opening of said lower canopy and connected to said outer portion of said upper canopy for operably and manually moving said outer portion of said upper canopy between a concave position and a convex position while said lower canopy and said inner portion of said upper canopy are retained concavely and such that said outer portion of said upper canopy covers said opening when in said concave position to restrict air passage through said opening and such that said outer portion of said upper canopy exposes said opening when in said convex position to permit air passage through said opening, wherein said second supporting assembly is adapted to retain said upper canopy in said convex position until manually reverted back to said concave position;

wherein said first supporting assembly includes:

a plurality of first ribs each having an inner end and an outer end, said inner end of said first ribs being retained along an upper end of said shaft and said outer end of said first ribs being retained adjacent a first peripheral edge of said lower canopy;

a plurality of stretchers each having an inner end and an outer end, said outer end of said stretchers being pivotally connected to said first ribs between said inner and outer ends of said first ribs; and a runner movable along said shaft, said inner end of said stretchers being pivotally connected to said runner, wherein said operable movement of said runner causes said stretchers and said first ribs to move and thus adjust said lower canopy between said closed position and said open position;

wherein said second supporting assembly includes:

a plurality of second ribs each having an inner end and an outer end, said inner end of said second ribs being retained upon said first ribs between said inner and outer ends of said first ribs and said outer end of said second ribs being retained along a second peripheral edge of said upper canopy;

wherein said inner portion of said upper canopy retains a shape of said first ribs and wherein said outer portion of said canopy retains a shape of said second ribs, wherein said second ribs adjust from said concave position to said convex position.

2. The umbrella of claim 1, wherein said outer portion angles downwardly in said concave position and wherein said outer portion angles upwardly in said convex position.

3. The umbrella of claim 1, wherein said upper canopy is diametrically larger than said opening such that said upper canopy at least partially overlaps said lower canopy in said concave position of said upper canopy.

4. The umbrella of claim 3, wherein said lower canopy is diametrically larger than said upper canopy.

5. The umbrella of claim 4, wherein said opening is centrally located upon said lower canopy and wherein said upper canopy is concentric with said lower canopy.

6. The umbrella of claim 1, wherein said shaft includes an upper portion, a lower portion, and a pivotal connector, wherein said upper portion angularly adjusts relative said lower portion via said pivotal connector.

7. The umbrella of claim 1, including a lower extension pole removably connected to said shaft along a lower end of said shaft, wherein said lower extension pole is linearly connected to said shaft.

8. The umbrella of claim 7, wherein said lower extension includes a ground engaging spike.

9. An umbrella with multiple canopy structure, comprising:

a shaft;

a lower canopy having an opening;

an upper canopy having an inner portion and an outer portion, wherein said upper canopy is supported above said lower canopy and over said opening;

wherein said upper canopy is diametrically larger than said opening;

wherein said lower canopy is diametrically larger than said upper canopy;

a first supporting assembly connected to said shaft and said first and second canopies to operably move said first and second canopies between a closed position and an open position, wherein said inner portion of said upper canopy moves with said first supporting assembly; and a second supporting assembly connected to said first supporting assembly within said opening of said lower canopy and connected to said outer portion of said upper canopy for operably moving said outer portion of said upper canopy between a concave position and a convex position while said lower canopy and said inner portion of said upper canopy are retained concavely and such that said outer portion of said upper canopy covers said opening when in said concave position to restrict air passage through said opening and such that said outer portion of said upper canopy exposes said opening when in said convex position to permit air passage through said opening, wherein said second supporting assembly is adapted to retain said upper canopy in said convex position until manually reverted back to said concave position;

wherein said outer portion angles downwardly in said concave position and wherein said outer portion angles upwardly in said convex position;

wherein said first supporting assembly includes:

a plurality of first ribs each having an inner end and an outer end, said inner end of said first ribs being retained along an upper end of said shaft and said outer end of said first ribs being retained adjacent a first peripheral edge of said lower canopy;

a plurality of stretchers each having an inner end and an outer end, said outer end of said stretchers being pivotally connected to said first ribs between said inner and outer ends of said first ribs; and a runner movable along said shaft, said inner end of said stretchers being pivotally connected to said runner, wherein said operable movement of said runner causes said stretchers and said first ribs to move and thus adjust said lower canopy between said closed position and said open position;

wherein said second supporting assembly includes:

a plurality of second ribs each having an inner end and an outer end, said inner end of said second ribs being retained upon said first ribs between said inner and outer ends of said first ribs and said outer end of said second ribs being retained along a second peripheral edge of said upper canopy;

wherein said inner portion of said upper canopy retains a shape of said first ribs and wherein said outer portion of said canopy retains a shape of said second ribs, wherein said second ribs adjust from said concave position to said convex position.

10. The umbrella of claim 9, wherein said upper canopy at least partially overlaps said lower canopy in said concave position of said upper canopy.

11. The umbrella of claim 9, wherein said opening is centrally located upon said lower canopy and wherein said upper canopy is concentric with said lower canopy.

12. The umbrella of claim 9, wherein said first ribs and said second ribs are each comprised of a bendable rod structure.

13. The umbrella of claim 9, wherein said shaft includes an upper portion, a lower portion, and a pivotal connector, wherein said upper portion angularly adjusts relative said lower portion via said pivotal connector.

14. The umbrella of claim 9, including a lower extension pole removably connected to said shaft along a lower end of said shaft, wherein said lower extension pole is linearly connected to said shaft.

15. The umbrella of claim 14, wherein said lower extension includes a ground engaging spike.

16. An umbrella with multiple canopy structure, comprising:

an elongated shaft;

a lower canopy having an opening;

an upper canopy having an inner portion and an outer portion, wherein said upper canopy is supported above said lower canopy and over said opening;

wherein said lower canopy is diametrically larger than said upper canopy;

wherein said upper canopy is diametrically larger than said opening;

wherein said opening is centrally located upon said lower canopy and wherein said upper canopy is concentric with said lower canopy;

a first supporting assembly including a plurality of first ribs, a plurality of stretchers, and a runner, wherein said plurality of first ribs each have an inner end and an outer end, said inner end of said first ribs being retained along an upper end of said shaft and said outer end of said first ribs being retained adjacent a first peripheral edge of said lower canopy, wherein said plurality of stretchers each have an inner end and an outer end, said outer end of said stretchers being pivotally connected to said first ribs between said inner and outer ends of said first ribs, and wherein said runner is movable along said shaft, said inner end of said stretchers being pivotally connected to said runner;

wherein said operable movement of said runner causes said stretchers and said first ribs to move and thus adjust said lower canopy between a closed position and an open position; and a second supporting assembly including a plurality of second ribs each having an inner end and an outer end, said inner end of said second ribs being retained upon said first ribs between said inner and outer ends of said first ribs and said outer end of said second ribs being retained along a second peripheral edge of said upper canopy;

wherein an inner portion of said upper canopy retains a shape of said first ribs and wherein an outer portion of said canopy retains a shape of said second ribs, wherein said second ribs adjust from a downwardly-angled concave position to an upwardly-angled convex position, wherein said upper canopy at least partially overlaps said lower canopy in said concave position of said upper canopy, wherein said second supporting assembly is adapted to retain said upper canopy in said convex position until manually reverted back to said concave position;

wherein said first ribs and said second ribs are each comprised of a bendable rod structure.

* * * * *